United States Patent [19]

Andreasson et al.

[11] 4,047,165

[45] Sept. 6, 1977

[54] EMERGENCY SIGNAL LIGHT

[76] Inventors: Betty Andreasson; Rebecca M. Anderson, both of 50 Russell Hill Road, Ashburnham, Mass. 01430

[21] Appl. No.: 688,173

[22] Filed: May 20, 1976

[51] Int. Cl.[2] ..... G08B 21/00

[52] U.S. Cl. ..... 340/227 R; 340/331; 340/366 D

[58] Field of Search ..... 340/283, 227 R, 227.1, 340/228 R, 331, 366 D, 373, 321

[56] References Cited

U.S. PATENT DOCUMENTS

| | | | |
|---|---|---|---|
| 3,266,014 | 8/1966 | Leotta | 340/321 X |
| 3,622,979 | 11/1971 | Dickerson | 340/321 X |
| 3,943,499 | 3/1976 | Dunphy | 340/283 X |

*Primary Examiner*—Glen R. Swann, III

*Attorney, Agent, or Firm*—Eugene V. Mandel

[57] ABSTRACT

An emergency warning flashing battery operated signal light having a depressable switch and an automatic heat sensing switch.

6 Claims, 3 Drawing Figures

EMERGENCY SIGNAL LIGHT

BACKGROUND OF THE INVENTION

1. Field of the Invention

This invention relates to emergency warning equipment, and, in particular, to visual signals. It relates further to emergency fire warning equipment.

2. Prior Art

Emergency warning equipment originated with the horn, then the toisin, later the bell, and we now are all familiar with visual and audio signals of various types, particularly those employing a varying signal to attract human attention.

Amongst known devices we find Klingenberg's window pane system disclosed in U.S. Pat. No. 3,913,092 and Less roof mounted system disclosed in U.S. Pat. No. 3,624,635. Neither of these systems includes automatic fire warning capability.

SUMMARY

It is therefore an object of this invention to overcome the limitations and disadvantages in the emergency warning light devices in the prior art and currently available in the market.

One of the objects of the invention is to provide an emergency warning light device embodying improved principles of design and construction.

An important object of the invention is to provide an emergency warning light device which is comprised of a number of simple parts and components which can be economically manufactured and readily assembled.

A significant object of the invention is to provide an emergency warning light device, so designed and constructed that it can be easily and quickly installed to almost any typical window unit now in use.

Another object of the invention is to provide an emergency warning signal light capable of manual or automatic operation.

A further object of the invention is to provide an emergency warning signal light automatically operated by a heat sensor.

Yet another object of the invention is to provide a tape mounting capability in an emergency warning signal light.

A still further object of the invention is to provide an emergency warning signal light having a magnetic mounting.

An emergency warning signal light, according to the principles of this invention, comprises a base, a transluscent housing, a first flashing light, a depressable switch, a second flashing light, a heat sensing switch, an electrical energy storage source, a tape mounting, a magnetic mounting, and a rotator.

Further objects and advantages of this invention will appear more clearly from the following description of a non-limiting illustrative embodiment and the accompanying drawings in which like numerals designate like parts thruout the several views.

DESCRIPTION OF DRAWINGS

Briefly summarized, a preferred embodiment of the invention is described in conjunction with an illustrative disclosure thereof in the accompanying drawings, in which.

DESCRIPTION OF TYPICAL EMBODIMENT

Figure 1:
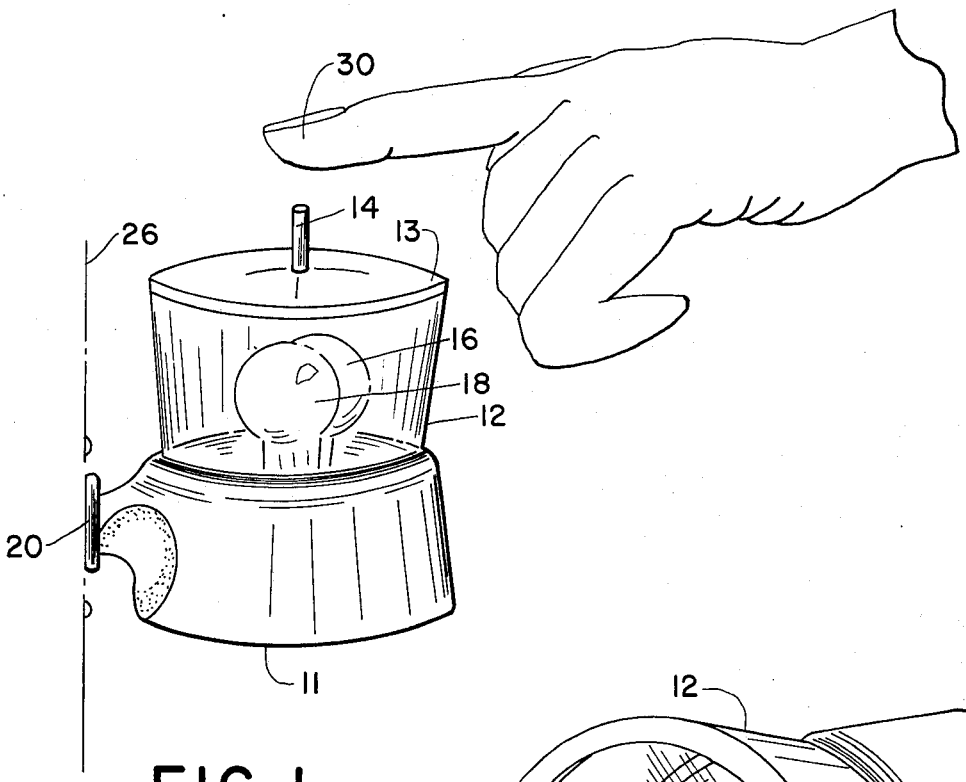
FIG. 1 is a pictorial representation of the emergency light shown in its storage position attached to a window casing or the like according to the principles of this invention.
Figure 2:
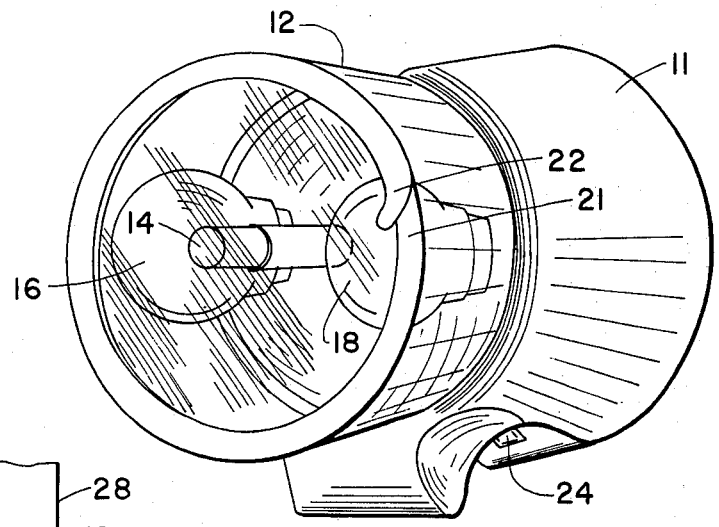
FIG. 2 is another pictorial view of the unit showing the mounting tape ready to be peeled off.
Figure 3:
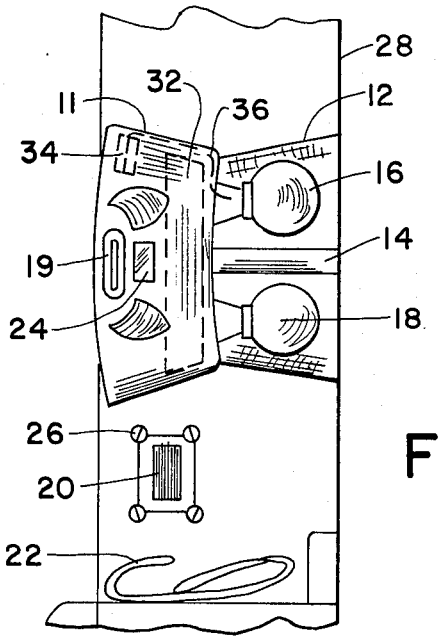
FIG. 3 is a side elevation view showing the light mounted to a window pane.

In the drawings an emergency warning signal light embodying features of the invention is illustrated having a base 11 which mounts electric lamps 16 and 18, a depressable switch 14, a magnet 24, a heat sensing electrical switch 19 and a transluscent housing 12 which may have a top 13.

The lamps 16, 18 are connected to an electrical energy source which may be one or more batteries 34 thru switches 14, 19. Switch 14 may be manually depressed by finger 30 as in testing as shown in FIG. 1, or may be depressed when the unit is mounted with surface 13 against a hard surface, such as a window pane 28.

The heat sensing switch 19 is intended for automatic operation as a fire emergency warning signal device.

The transluscent housing 12 may be mounted by use of an adhesive tape 21 with grab tab 22 to any suitable hard surface. Housing 12 may be clear or colored such as red for warning. The lamp 16 is preferably white to indicate a call for assistance, and lamp 18 is preferably blue to indicate a fire warning. With a red housing 12, white lamp 16 creates a red appearance and blue lamp 18 a purple appearance.

When not in use, the unit may be stored by hanging, as to a magnetic latch 20 in a housing retained to an available surface, such as a window casing 26, by conventional fasteners 26 such as screws. Either 20 or 24 or both may be magnets, and housing 11 may be of a magnetic material such as steel.

A rotary device such as an electric motor 32 may be provided to create known rotating variable visual signal effects. The various electrical components may be connected by suitable conductors 36.

For attracting attention, flashing light is preferable. A known interrupting flasher may be provided or lamps 16, 18 may be known flashing types.

In use, the unit would be taken from its at-rest storage position, the covering tape removed, and the unit adheringly attached to a window pane 28.

This automatically depresses switch 14 and turns on lamp 16.

This unit is of great advantage to confined people as in nursing homes and the like. The flashing light attracts attention as of fire rescue crews.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. An emergency warning signal light comprising a base to which is attached a transluscent housing, an electrical energy source, a first flashing lamp electrically connected to the energy source through a depressable electrical switch, and a second flashing lamp electrically connected to the energy source through a heat-sensing switch; the combination providing a selective signaling and automatic warning system.

2. A light as in claim 1 wherein the heat sensing switch is latchable.

3. A light as in claim 1 further comprising a magnetic mounting system for the base.

4. A light as in claim 1 further comprising an adhesive tape mounting system for the housing.

5. A light as in claim 1 further comprising a rotary device such as an electric motor to rotate the lamps when energized.

6. A light as in claim 1 further comprising a switch actuator extending through the top of the transluscent housing, the actuator depressable to the level of the top.

* * * * *